United States Patent [19]

Keturi et al.

[11] 4,010,581

[45] Mar. 8, 1977

[54] CORED SLAB BUILDING CONSTRUCTION

[76] Inventors: Raymond C. Keturi, 129 Kantishna Way, Fairbanks, Alaska 99701; Wayne R. Sandstrom, P.O. Box 1993, Fairbanks, Alaska 99707

[22] Filed: July 17, 1975

[21] Appl. No.: 596,638

[52] U.S. Cl. ..... 52/220; 52/221; 52/259

[51] Int. Cl.[2] ..... E04B 5/48

[58] Field of Search ..... 52/220, 221, 259

[56] References Cited

UNITED STATES PATENTS

| | | | |
|---|---|---|---|
| 1,618,696 | 2/1927 | Bemis | 52/220 |
| 2,184,714 | 12/1939 | Freeman | 52/220 X |
| 2,294,554 | 9/1942 | Henderson | 52/221 X |
| 3,391,507 | 7/1968 | Downing | 52/221 X |
| 3,417,191 | 12/1968 | Fork | 52/221 X |
| 3,503,165 | 3/1970 | Hardt | 52/221 X |
| 3,908,324 | 9/1975 | Stout | 52/100 |

FOREIGN PATENTS OR APPLICATIONS

| | | | |
|---|---|---|---|
| 1,083,514 | 6/1954 | France | 52/220 |

*Primary Examiner*—Alfred C. Perham
*Attorney, Agent, or Firm*—Bacon & Thomas

[57] ABSTRACT

A building construction of precast concrete slabs having cored channels running therethrough. The slabs are arranged to define upstanding walls and horizontal floor-ceiling members. Openings concealed by the junctures between slabs, provide communication between channels of adjacent slabs. Further openings, displaced from the junctures, provide for access to the communicating channels for installation or service of utilities in those channels, after the building is erected.

2 Claims, 4 Drawing Figures

CORED SLAB BUILDING CONSTRUCTION

BACKGROUND OF THE INVENTION

This invention is in the field of building construction and components therefor comprising precast reinforced concrete panels or slabs.

Many proposals have been made for assembling buildings or the like from precast concrete slabs, including the provision of passageways in the slabs for the reception of service utility components, such as electrical wiring, water pipes or the like. However, in all such proposals known to the applicants, it was necessary to install the utility components simultaneously with the assembly of the slabs into the building since it was only at that time that the channels or passageways were accessible for making the necessary connections.

SUMMARY OF THE INVENTION

The present invention comprises a building structure and components thereof comprising precast reinforced concrete slabs having passageways extending therethrough from edge to edge and which are arranged with passageways in alignment between horizontal and vertical members and between vertically aligned slabs. Provision is made for making openings into the passageways from within the enclosure whereby utility components may be installed after a building is erected.

It is, therefore, a principal object of this invention to provide a building construction and components therefor providing for installation of utility service members after the building has been constructed and wherein the utility components are completely housed within the precast building slabs.

DESCRIPTION OF THE PREFERRED EMBODIMENTS

Figure 1:
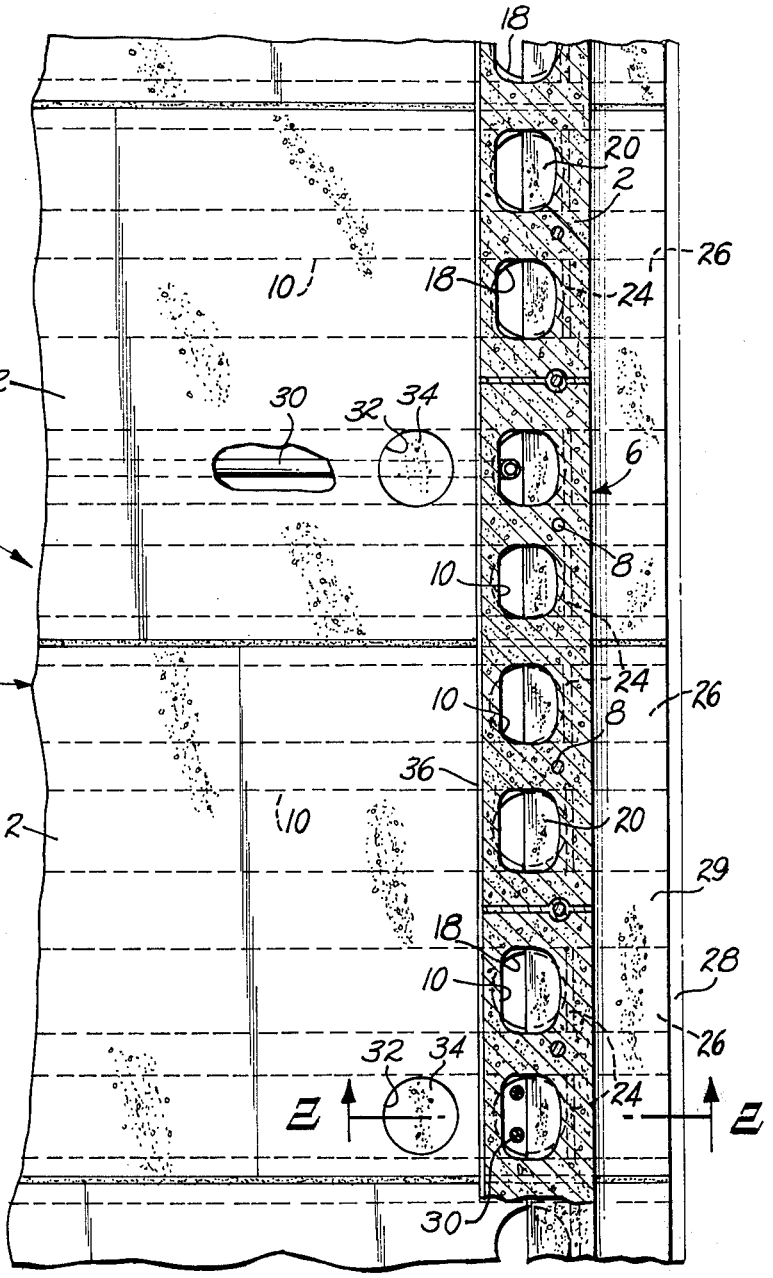
FIG. 1 is a fragmentary horizontal sectional view through a portion of a building construction in accordance with the present invention, with parts thereof broken away.

As shown in FIG. 1, for example, the present invention involves precast concrete slabs 2, a plurality of which are arranged in edge-to-edge relation to define horizontal members or assemblies, such as a floor-ceiling level 4 or a vertical wall-defining assembly 6. It is contemplated that the slabs employed for both the floor-ceiling arrangement and the wall assembly be of the same construction and they may be identical slabs. Each of the slabs is precast and provided with suitable internal reinforcement rods such as those shown at 8 and each is formed with a multiplicity of parallel cored openings 10 extending therethrough from one edge to an opposed edge, the cored openings opening through those edges. In erecting a building from such slabs, a suitable assembly of slabs may be positioned vertically, as shown at 12 in FIG. 2 to define an upstanding wall with the openings 10 extending vertically therein. A precast beam member 14 is positioned along the top edge of the wall 12, the beam 14 being of a width less than that of the wall 12 so that portions of the openings 10 are exposed inwardly of the beam 14. A horizontally arranged assembly of floor-ceiling slabs 16 is then positioned to overlie and rest on the beam 14 with the openings 10 thereof lying in essentially the same vertical plane as corresponding openings 10 in the wall assembly 12. Before so positioning the slabs 16, however, openings 18 are formed therein to be aligned with the exposed portions of the openings 10 in the wall structure 12. Thus, communication between the openings 10 of wall 12 and the openings 10 of assembly 16 is provided past the inner edge of the beam 14.

Thereafter, a second beam 20 is positioned atop the assembly 16 directly over the beam 14 and a second wall assembly 22 of slabs 2 is positioned thereon with its openings 10 aligned with those of assembly 12 and, as previously described, access between the openings 10 of assembly 22 and openings 10 of assembly 16 is provided.

Figure 2:
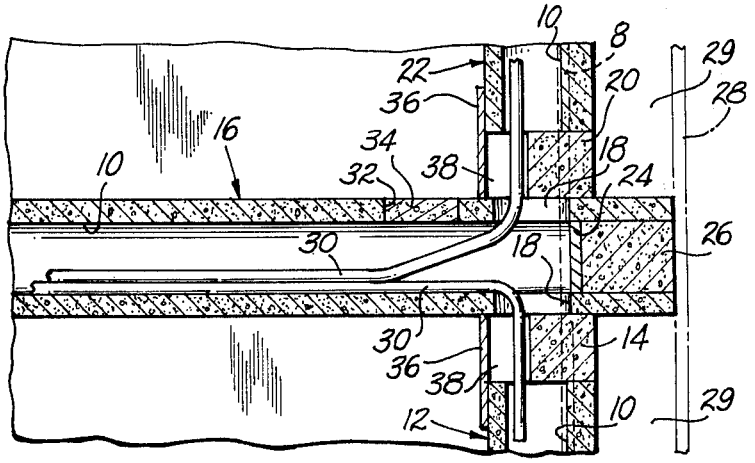
FIG. 2 is a vertical sectional view taken on the line 2—2 of FIG. 1.

As shown, the assembly 16 is arranged to extend outwardly beyond the upper edges of the wall assemblies 12 and 22. The openings 10 thereof are plugged by suitable means 24 and the openings 10 outwardly of those plugs are filled with concrete or the like 26. As shown in FIG. 2, an outer facing or weather slab 28 is employed to finish the outside of the building and insulation may be placed in the space 29 if desired.

After the building or a substantial portion thereof has been erected as described above, utility components, such as electrical wiring or pipes 30 may be installed by extending the same along the selected passageways 10 in either the floor-ceiling assemblies or the vertical wall assemblies. Where desired, holes 32 are cut through the appropriate floor-ceiling slabs into the selected opening 10 and thus access is provided for steering or directing the utility units 30 to or from the openings 18 and from thence along the selected opening 10 in an adjacent slab assembly, as shown in FIG. 2. After the utility components have been installed, the openings 32 may be closed by suitable plugs 34 or the like and cover members 36 are applied to cover the outer open portions of the channels 38 defined by an edge portion of a vertical wall slab and the inner edge of the beams 14 and 20.

Figure 3:
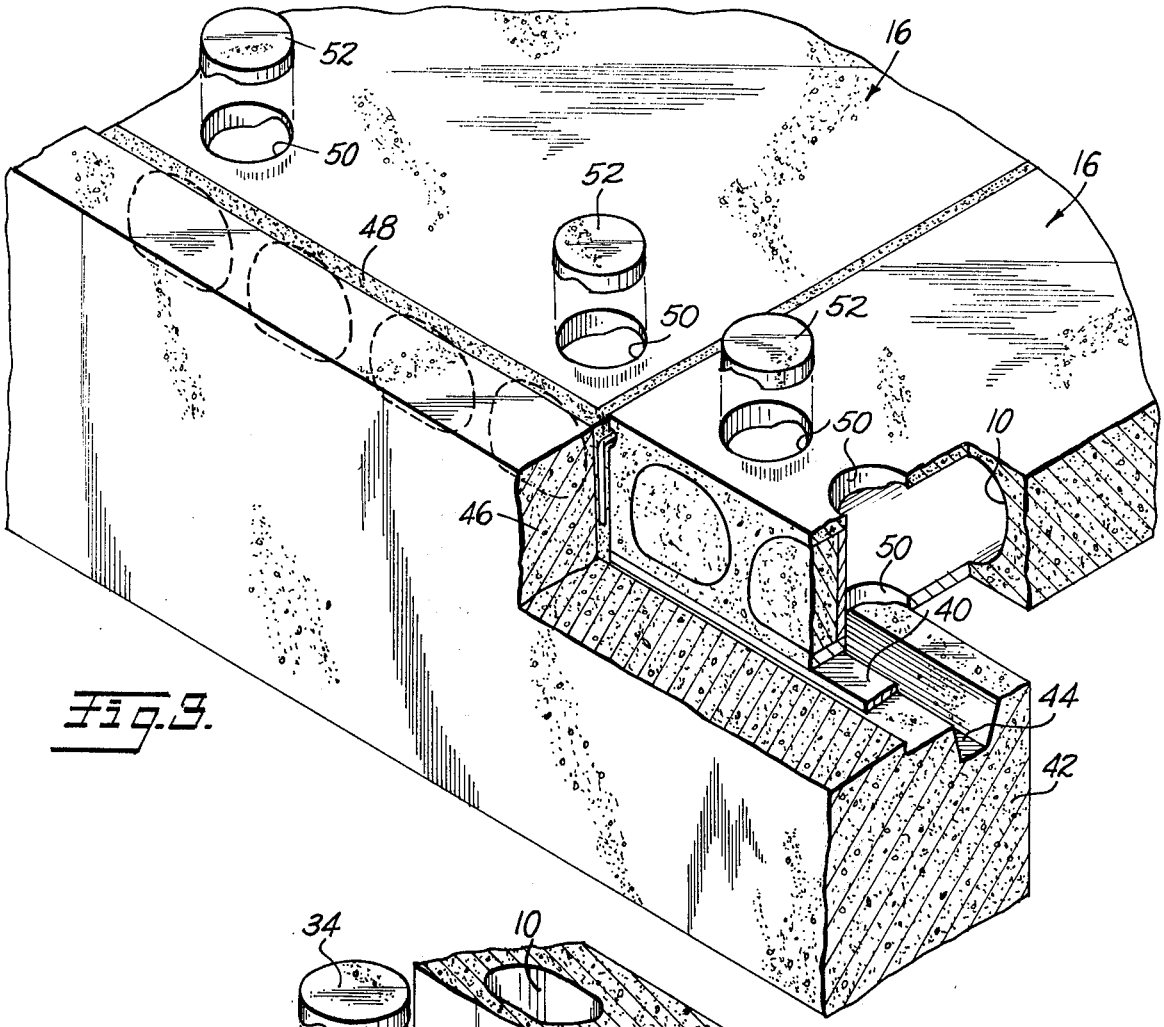
FIGS. 3 and 4 are partial sectional perspective views of modified forms of the invention.

In FIG. 3, an assembly 16 of floor slabs, which may be the same as those described with reference to FIG. 2, is arranged to bear on an elongated bearing member 40 which in turn rests on any suitable support or foundation 42. The foundation 42 is provided with an upwardly facing channel 44 therein which will be spaced, by the thickness of the member 40, from the bottom surface of the slab assembly 16. As shown, the foundation member 42 extends upwardly outwardly of the adjacent edge of the slab assembly 16, as at 46 and against which the ends of the slab 16 abut and to which they are sealed by grout 48. The slabs of assembly 16 are provided with openings 50 where desired to provide communication with the channel 44 and thus utility components may be extended either along channel 44 or along one of the openings 10 to the juncture between the member 42 and a desired opening 10 in one of the slabs. The openings 50 through the upper and lower surfaces of the slab 16 provide communication from within the building to the openings 10 and channel 44 whereupon utility components may be threaded or directed from one to the other as desired. Here again, after installation of the utility components, suitable plugs 52 are inserted in the openings 50 through the upper surface of the slab assembly 16 to close the same. Obviously, wiring or the like may be installed after a building has been completed.

Figure 4:
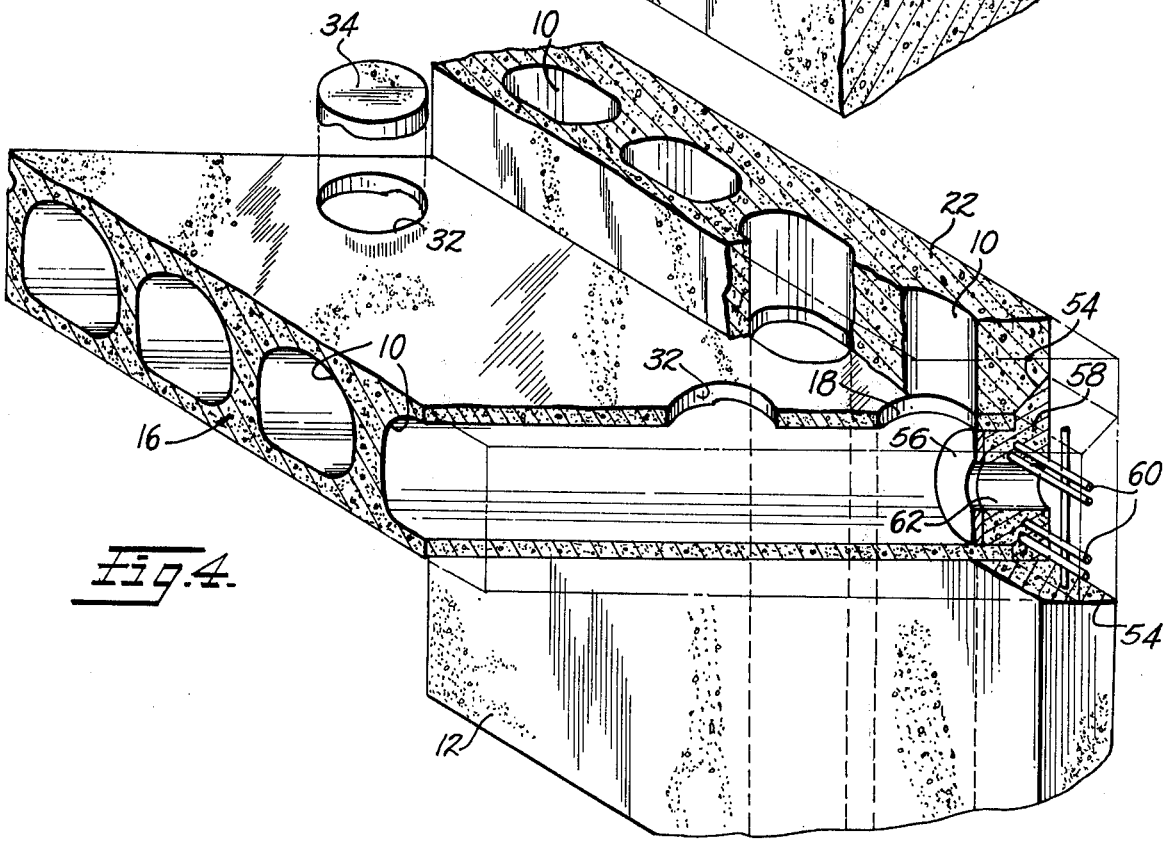

The form of invention shown in FIG. 4 is a modification of that shown in FIG. 2 and like reference numerals designate similar parts. In this form, a vertical wall assembly 12 is erected and the horizontal floor-ceiling slabs of assembly 16 are positioned to rest thereon but in this form the horizontal slabs do not extend outwardly beyond the vertical wall. They actually terminate somewhat short thereof. The upper edge of the lower vertical wall 12 and the lower edge of the upper vertical wall 22 are bevelled at their outer edge portions, as shown at 54 and after the slabs have been placed in position, suitable plugs 56 are positioned in the openings 10 of the floor-ceiling slabs and concrete or the like 58 completes the outer surface of the building and extends to the bevelled portions 54 and is formed flush with the outer surface of the vertical wall slabs, suitable reinforcing rods 60 being positioned therein to add strength to the completed structure. If desired, the concrete filler 58 may be provided with one or more openings 62 therethrough to provide external access to the openings 10. Here again, the floor slabs of assembly 16 are provided with the openings 18 to establish communication between openings 10 in the vertical wall structures and the openings 10 in the horizontal slab assembly 16 and access openings 32 may be provided where desired for installation of utility components after which plugs 34 are placed in the opening to close the same.

While a limited number of specific embodiments of the invention have been shown herein, the same are merely illustrative of the principles involved and other forms may be resorted to within the scope of the appended claims.

We claim:

1. In a building construction employing precast concrete slabs having generally parallel core channels extending therethrough from one edge to an opposed edge between opposed faces thereof, the improvement comprising:

a first of said slabs arranged to define an upstanding wall with its core channels extending vertically;

a second of said slabs arranged generally horizontally with its core channels extending perpendicular to said first slab and with said second slab extending across the upper edge of said first slab;

said second slab having at least one opening through its face adjacent said edge of said first slab, said opening being between the faces of said first slab and communicating with one of the core channels of said second slab;

plug means closing those ends of all the core channels of said second slab adjacent said first slab; and a solid precast beam member extending along said edge of said first slab and being of a width to cover only a portion of the ends of the core channels of said first slab and thereby define a channel extending along said edge and open at one side of said first slab.

2. In a building construction employing precast concrete slabs having generally parallel core channels extending therethrough from one edge to an opposed edge between opposed faces thereof, the improvement comprising:

one of said slabs being arranged generally horizontally with one edge portion thereof resting on a supporting structure including an elongated beam member with its core channels extending perpendicular to said beam member, said supporting structure and beam member defining an open channel extending along and facing said one edge portion of said slab, and at least one opening in a face of said slab providing communication between said open channel and one of the core channels of said slab.

* * * * *